US010124552B2

(12) United States Patent
Chacon

(10) Patent No.: US 10,124,552 B2
(45) Date of Patent: Nov. 13, 2018

(54) PORTABLE CARDBOARD BALER

(71) Applicant: Ysidro Chacon, Squaw Valley, CA (US)

(72) Inventor: Ysidro Chacon, Squaw Valley, CA (US)

( * ) Notice: Subject to any disclaimer, the term of this patent is extended or adjusted under 35 U.S.C. 154(b) by 0 days.

(21) Appl. No.: 15/885,247

(22) Filed: Jan. 31, 2018

(65) Prior Publication Data

US 2018/0169986 A1 Jun. 21, 2018

Related U.S. Application Data

(63) Continuation-in-part of application No. PCT/US2015/043040, filed on Jul. 31, 2015.

(51) Int. Cl.
*B30B 9/30* (2006.01)
*B30B 15/16* (2006.01)

(52) U.S. Cl.
CPC ..... *B30B 9/3007* (2013.01); *B30B 9/301* (2013.01); *B30B 9/3014* (2013.01); *B30B 9/3046* (2013.01); *B30B 9/3057* (2013.01); *B30B 15/16* (2013.01)

(58) Field of Classification Search
CPC ..... B30B 9/3007; B30B 9/301; B30B 9/3014; B30B 9/3021; B30B 9/3032; B30B 9/3046; B30B 9/3057; A01F 15/0875
USPC ..... 100/218
See application file for complete search history.

(56) References Cited

U.S. PATENT DOCUMENTS 3,575,104 A * 4/1971 Aluotto ..... B30B 9/3014 100/218
3,851,577 A * 12/1974 Newcom ..... B30B 9/3014 100/100
3,937,140 A * 2/1976 Swanson ..... B30B 9/3032 100/215
4,136,610 A * 1/1979 Tyler, Jr. ..... B30B 9/30 100/100
4,232,599 A * 11/1980 Ulrich ..... B30B 9/3014 100/218
5,044,271 A * 9/1991 Robbins ..... B09B 3/0025 100/218
5,341,731 A * 8/1994 Grizzard, Jr. ..... B30B 9/3003 100/100

(Continued)

*Primary Examiner* — Jimmy T Nguyen
*Assistant Examiner* — Gregory Swiatocha

(57) ABSTRACT

The portable cardboard baler is an apparatus that receives, stores, compresses, and outputs recyclable items. The apparatus includes an enclosure, a bailing ram, an ejector mechanism, a control panel, a control unit, and a power source. The enclosure houses the bailing ram and the ejector mechanism. The elongated housing houses the recyclable items. The bailing ram compresses the recyclable items. The ejector mechanism pushes the bale of recyclable items out of the elongated housing. The apparatus preferably includes an input door that corresponds to a first opening of the elongated housing. The apparatus also includes a first output door and a second output door that corresponds to a second opening of the elongated housing. The apparatus preferably includes a plurality of environmental sensors to prevent a user from getting injured. The apparatus may further include a vehicle the directly transports the enclosure, the bailing ram, and the ejector mechanism.

22 Claims, 16 Drawing Sheets

(56) References Cited

U.S. PATENT DOCUMENTS

| | | | | |
|---|---|---|---|---|
| 5,590,594 | A * | 1/1997 | Pederson | B30B 9/3014 100/100 |
| 6,694,869 | B2 * | 2/2004 | Sutton | B30B 1/34 100/218 |
| 9,193,126 | B2 * | 11/2015 | Correale, Jr. | B30B 9/3007 |

* cited by examiner

PORTABLE CARDBOARD BALER

The current application is a Patent Cooperation Treaty (PCT) application and claims a priority to a U.S. provisional application serial number PCT/US2015/043040 filed on Jul. 31, 2015.

FIELD OF THE INVENTION

The present invention generally relates to a portable cardboard baler. More specifically, the present invention is a portable cardboard baler that is compatible with a vehicle. The portable cardboard baler can contain, compress, and output recyclable items while mounted onto a vehicle.

BACKGROUND OF THE INVENTION

Recycling cardboard is a hot commodity today. A cardboard collector receives about sixty to ninety dollars for truck loads for recycled material at recycle centers. Recyclable cardboard includes cardboard boxes from refrigerators, stoves, mattress boxes, various bulk products from stores, warehouses and much more.

A truck load of recyclable cardboard is equivalent to about one day of work of picking up cardboard. There is a typical route of businesses are taken by trucks since businesses produce much of this material to recycle. Unfortunately, most recyclable cardboard is taken directly to a landfill by the businesses because these businesses do not have time to break down a box. These businesses also do not want to spend more time and money on employees breaking down cardboard boxes flat. Though time consuming, the collection of cardboard is a sure source of income for those who do have the time.

Depending on what recycle centers pay for recyclable cardboard, cardboard recycling is an up and down market, but a steady source of income. Recycling cardboard is a way of life for some but are unable to maximize truck loads because they do not have the proper equipment available to them. More specifically, a portable machine which automatically compresses the cardboard is essential to maximize the payoff per truck load.

It is therefore an objective of the present invention to automatically compress recyclable cardboard with minimal to no manual input by a user. The present invention is sure to increase profit by three to four times per day and leaves no scrap behind. The present invention is self-contained with hydraulics for any sized trucks that are able to generate five to fifteen tons of pressure to compress bales of cardboard. Bales would be manageable for the elderly, handicap, single mother, or anyone lacking in upper body strength.

DETAIL DESCRIPTIONS OF THE INVENTION

Figure 1:
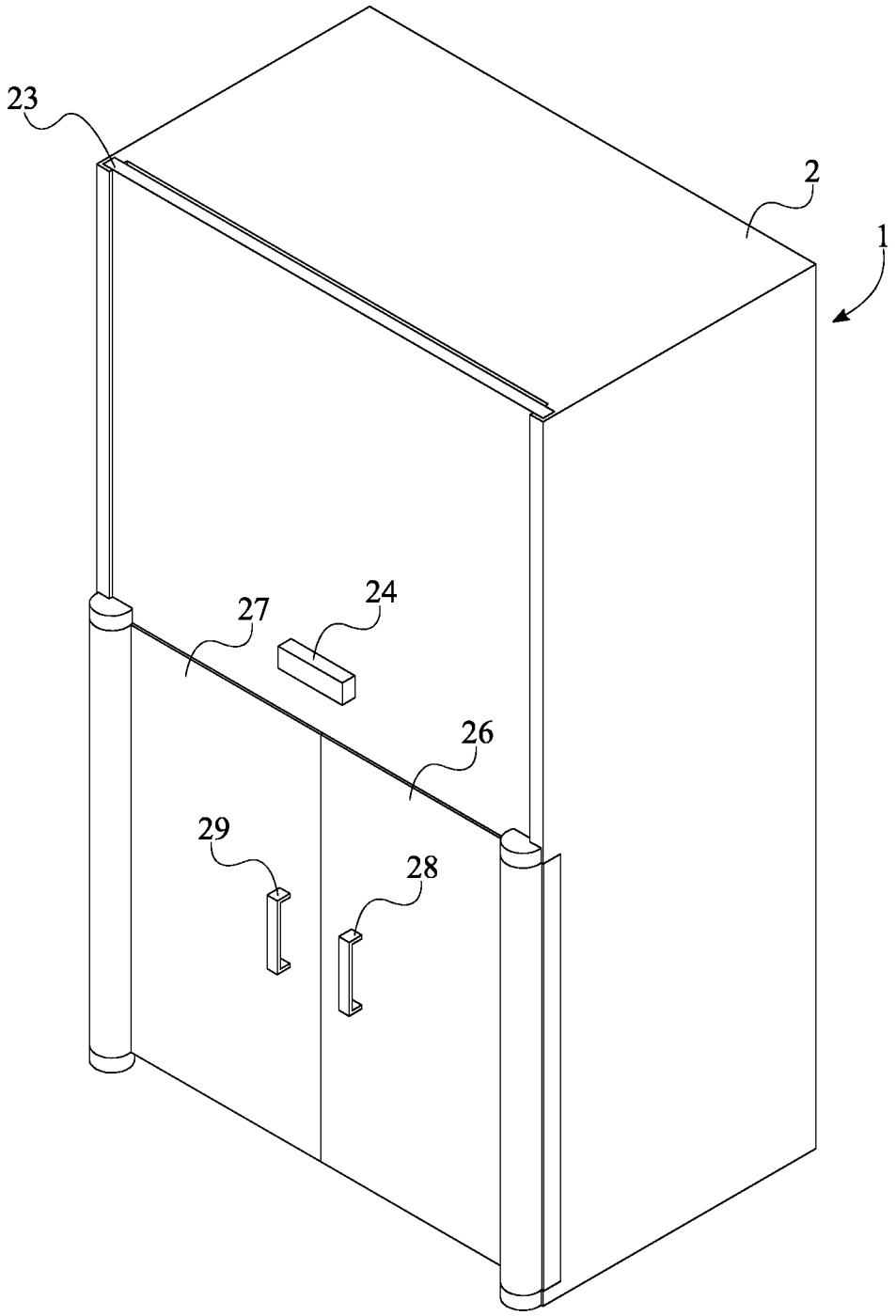
FIG. 1 is a perspective view of the preferred embodiment of the present invention.

All illustrations of the drawings are for the purpose of describing selected versions of the present invention and are not intended to limit the scope of the present invention.

The present invention is a portable cardboard baler that safely and efficiently compresses a variety of recyclable items, preferably cardboard boxes. The present invention may be oriented vertically or horizontally within a vehicle, depending on the overall structure of the vehicle and other items within the vehicle. The present invention allows a user to collect recyclable items and store the recyclable items until the present invention is filled with enough recyclable items. The present invention is able to directly compress the collected recyclable items and output a bale of recyclable items. In order to transport collected recyclable items and directly compress the collection of recyclable items, the present invention comprises an enclosure 1, a bailing ram 8, an ejector mechanism 13, a control panel 20, a control unit 21, and a power source 22, as seen in FIG. 1, FIG. 2, FIG. 3, and FIG. 10. The enclosure 1 houses the recyclable items before and after they are compressed. The enclosure 1 also contains the bailing ram 8 and the ejector mechanism 13. The bailing ram 8 presses on the collection of recyclable items and converts the collection of recyclable items into a bale of recyclable items. The ejector mechanism 13 pushes the bale of recyclable items out of the enclosure 1. The control panel 20 allows a user to input commands in order to control the bailing ram 8 and the ejector mechanism 13, and the control unit 21 processes the commands of the inputs from the control panel 20. The power source 22 delivers the necessary power to the bailing ram 8 and the ejector mechanism 13. In the preferred embodiment of the present invention, the power source 22 is a 12-volt battery, more specifically, the battery of a vehicle.

Figure 2:
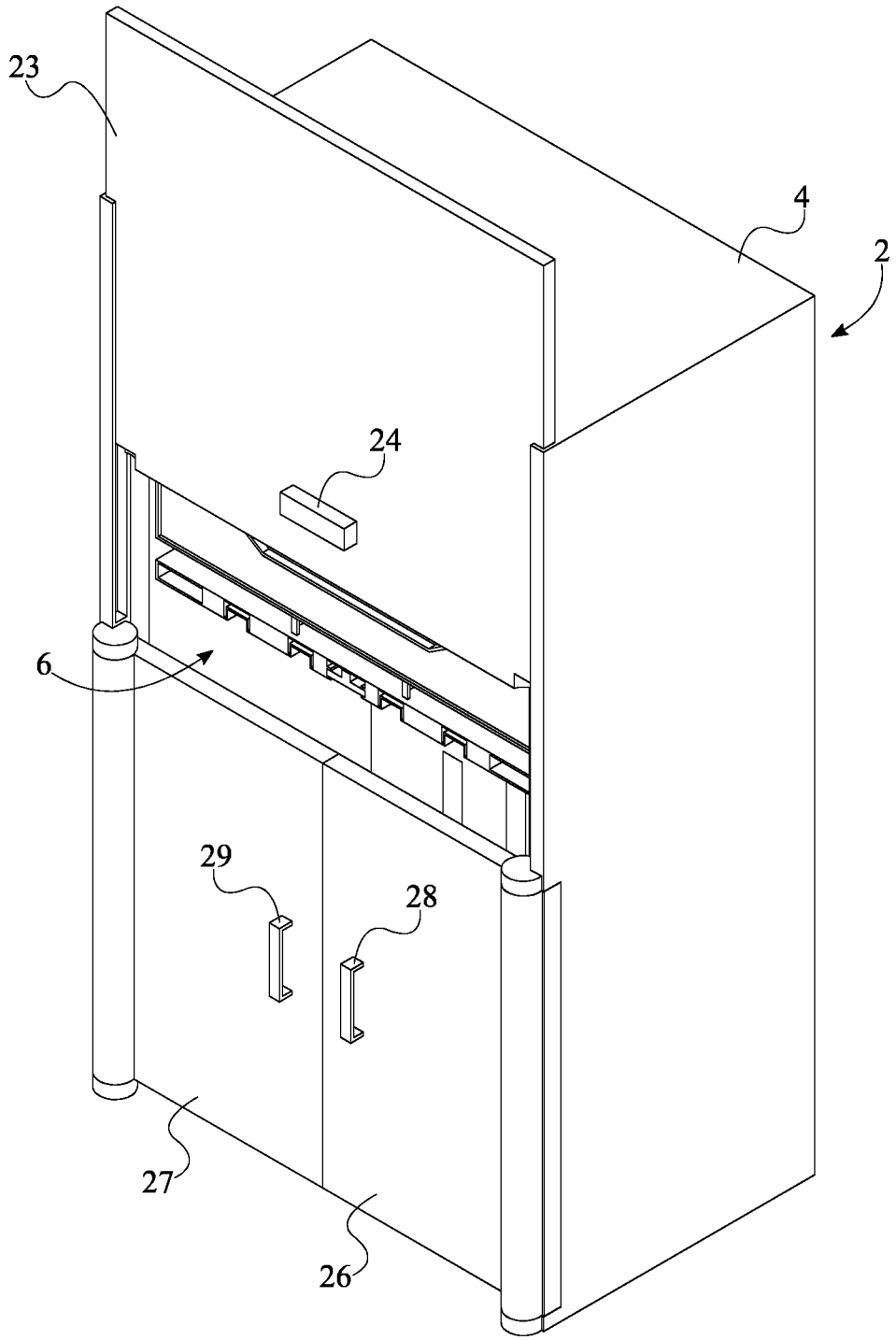
FIG. 2 is a perspective view of the preferred embodiment of the present invention with the first opening and the bailing ram exposed from within the enclosure.
Figure 3:
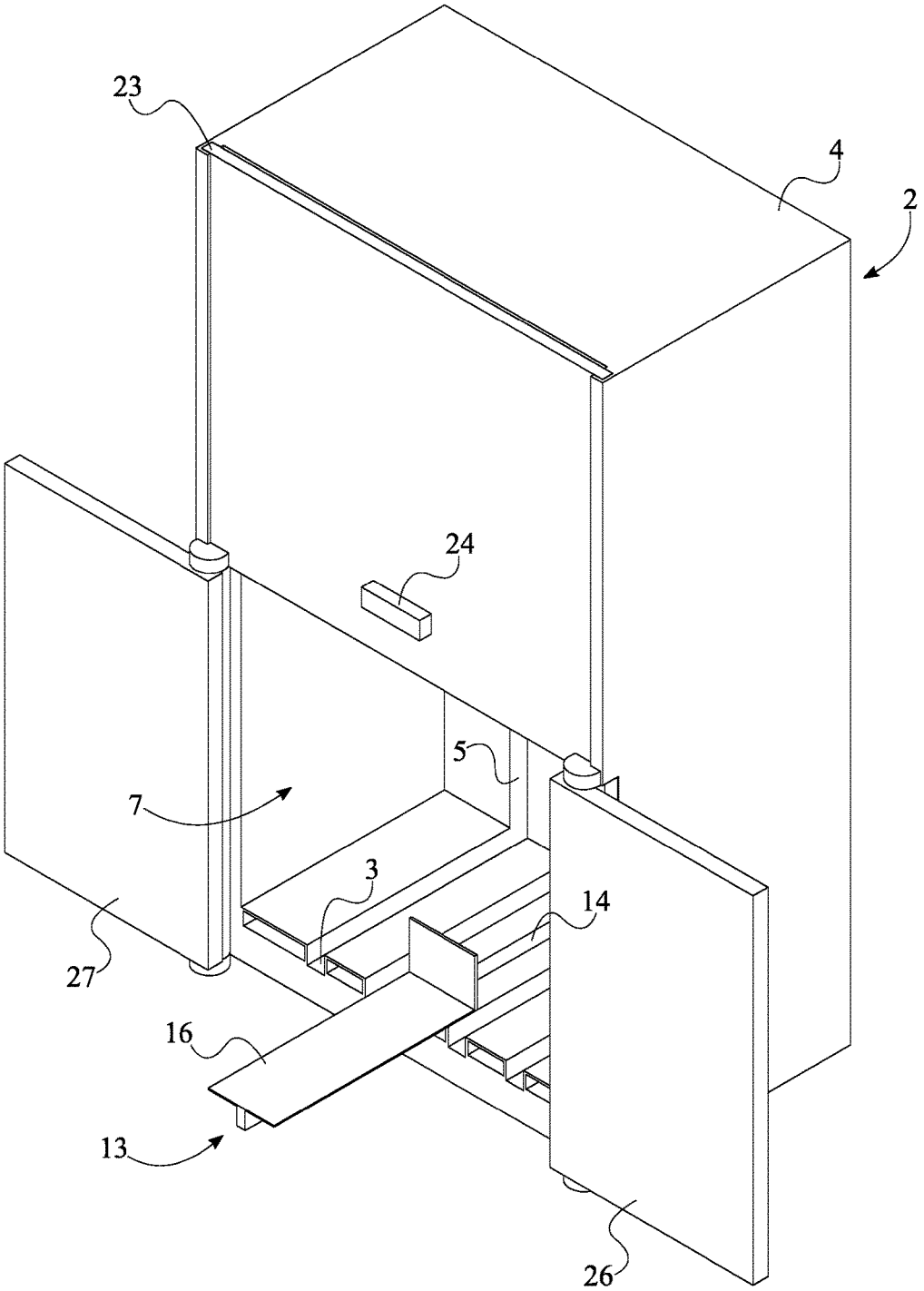
FIG. 3 is a perspective view of the preferred embodiment of the present invention with the second opening and the ejector mechanism exposed from within the enclosure.
Figure 4:
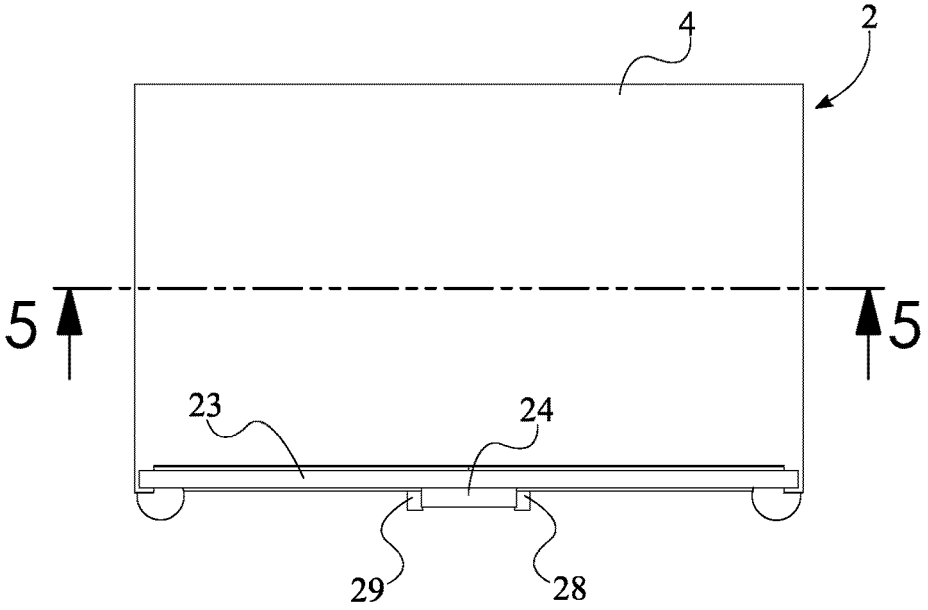
FIG. 4 is a top side view of the preferred embodiment of the present invention.
Figure 16:
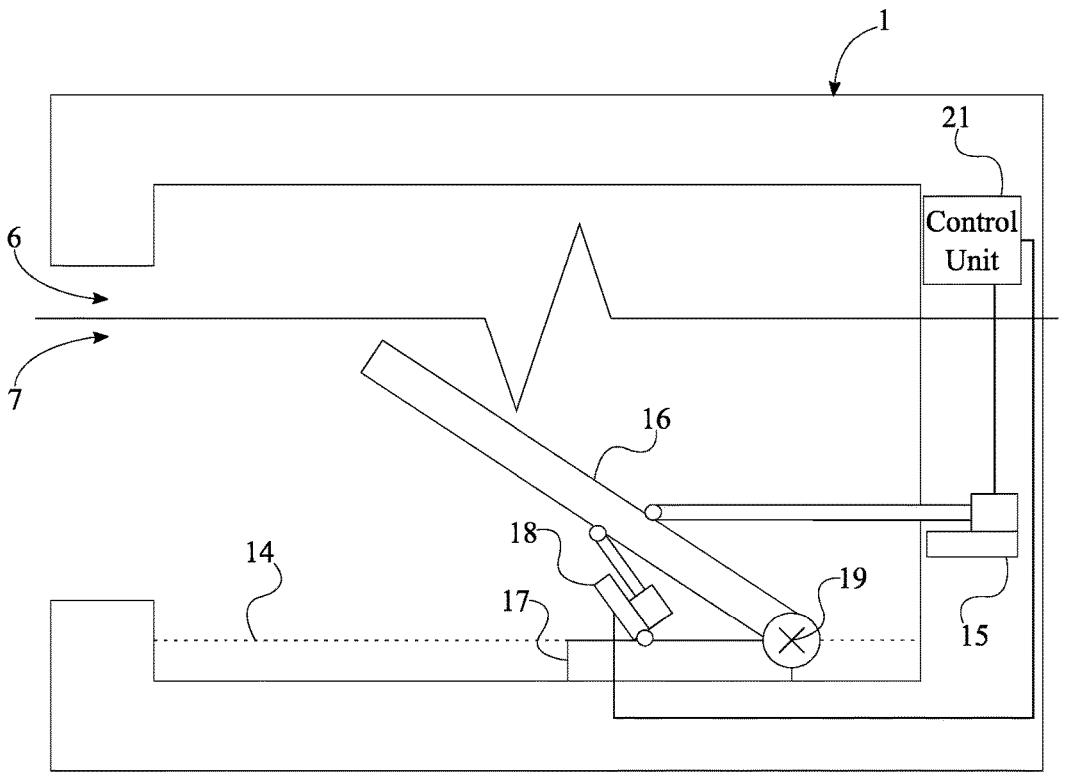
FIG. 16 is a schematic view of the connection between the supporting plate, the carriage, and the tilting actuator of the present invention.

In order to effectively contain the collection of recyclable items and the bale of recycle items, the enclosure 1 comprises an elongated housing 2, a first opening 6, and a second opening 7, seen in FIG. 2, FIG. 3, and FIG. 16. The elongated housing 2 contains the collection of recycle items as the bailing ram 8 presses upon the collection of recyclable items. The first opening 6 allows recyclable items to enter the elongated housing 2. The second opening 7 allows bales of recyclable items to exit the elongated housing 2.

The overall configuration of the aforementioned components allows a user to automatically compress and eject recyclable items. The first opening 6 and the second opening 7 laterally traverse into the elongated housing 2 and are positioned offset from each other along the elongated housing 2, also seen in FIG. 2, FIG. 3, and FIG. 16. This arrangement allows the enclosure 1 to be oriented vertically and horizontally within a vehicle 33 without obstructing the input of recyclable items through the first opening 6 and the output of bales through the second opening 7. In order to compress the collection of recyclable items within the enclosed housing 2, the bailing ram 8 is operatively mounted within the elongated housing 2, wherein the bailing ram 8 is used to compress loose items in between the bailing ram 8 and a base 3 of the elongated housing 2, the loose items preferably being recyclable items. In order for the bale of recyclable items within the elongated housing 2 to exit the elongated housing 2 without the user physically removing bale of recyclable items, the ejector mechanism 13 is operatively mounted within the elongated housing 2, offset from the second opening 7, wherein the ejector mechanism 13 is used to push out compressed items from the elongated housing 2 through the second opening 7. The arrangement of the bailing ram 8 and the ejector mechanism 13 within the elongated housing 2 enhances the safety of the present invention while minimizing manual input from the user. In order to operate the bailing ram 8 and the ejector mechanism 13, the control unit 21 is electronically connected to the control panel 20, the bailing ram 8, and the ejector mechanism 13. The bailing ram 8 and the ejector mechanism 13 are able to turn on and function as the power source 22 is electrically connected to the bailing ram 8 and the ejector mechanism 13.

The present invention further comprises an input door 23. The input door 23 shields the user from the bailing ram 8 by closing the first opening 6, illustrated in FIG. 1 and FIG. 2. The input door 23 also prevents any inserted recyclable items from escaping the elongated housing 2 through the first opening 6. The input door 23 is slidably mounted along the elongated housing 2 and is positioned adjacent the first opening 6. This arrangement facilitates path of recyclable items through the first opening 6 while protecting the user. The present invention further comprises a handle 24 which allows the user to open and close the first opening 6 with the input door 23. In order to manually engage the input door 23, the handle 24 is mounted onto the input door 23 and is positioned external to the elongated housing 2.

Figure 11:
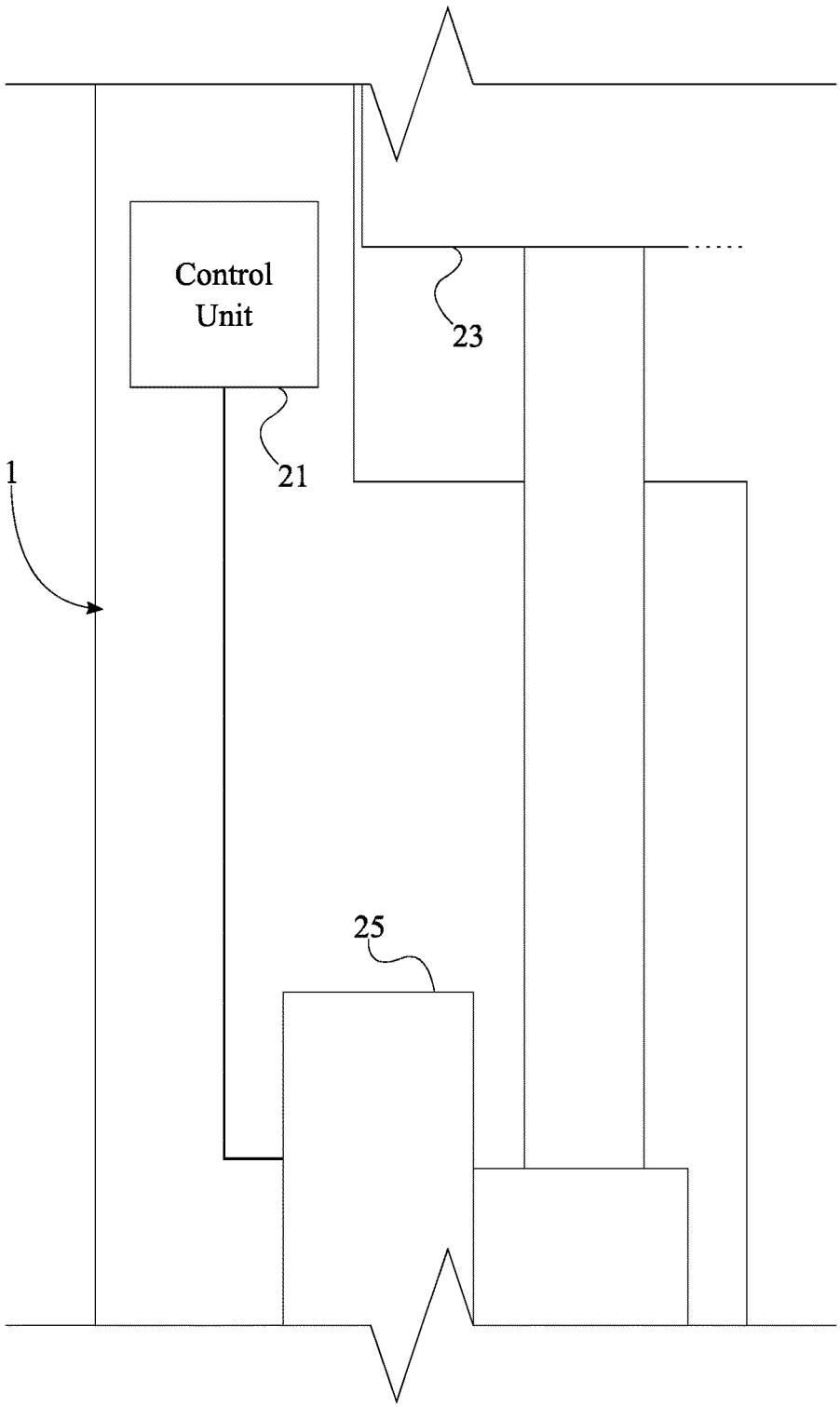
FIG. 11 is a schematic view of the connection between the input door and the lifting actuator of the present invention.

An alternate embodiment of the present invention comprises a lifting actuator 25, seen in FIG. 11. The lifting actuator 25 automatically opens and closes the first opening 6 with the input door 23. The lifting actuator 25 is operatively coupled in between the input door 23 and the elongated housing 2, wherein the lifting actuator 25 is used to open and close the input door 23 from the first opening 6. The user is able to control the input door 23 through the control panel 20 as the control unit 21 is electronically connected to the lifting actuator 25.

The present invention further comprises a first output door 26 and a second output door 27. The first output door 26 and the second input door 23 shield the user from both the bailing ram 8 and the ejector mechanism 13 by closing the second opening 7. As seen in FIG. 1 and FIG. 3, the first output door 26 is hingedly connected to the elongated housing 2. Similarly, the second output door 27 is hingedly connected to the elongated housing 2, thereby allowing bales of recyclable items to exit the elongated housing 2 through the second opening 7 while protecting the user. The hinged connection between the first output door 26 and the elongated housing 2 and the hinged connection between the second output door 27 and the elongated housing 2 are positioned opposite to each other about the second opening 7. This arrangement exposes the entirety of the second opening 7 with the first output door 26 and the second output door 27 completely extended. The present invention further comprises a first handle 28 and a second handle 29. The first handle 28 and the second handle 29 allow the user to manually open and close the second opening 7 with the first output door 26 and the second output door 27, respectively. The first handle 28 is mounted onto the first output door 26. Similarly, the second handle 29 is mounted onto the second output door 27. The first handle 28 and the second handle 29 are positioned external to the elongated housing 2 so that the user may maneuver the first output door 26 and the second output door 27, respectively, without compromising safety. More specifically, the first handle 28 and the hinged connection between the first output door 26 and the elongated housing 2 are positioned opposite to each other across the first output door 26. Similarly, the second handle 29 and the hinged connection between the second output door 27 and the elongated housing 2 are positioned opposite to each other across the second output door 27. This arrangement facilitates the opening and closing of the second opening 7 with the first output door 26 and the second output door 27, respectively.

Figure 12:
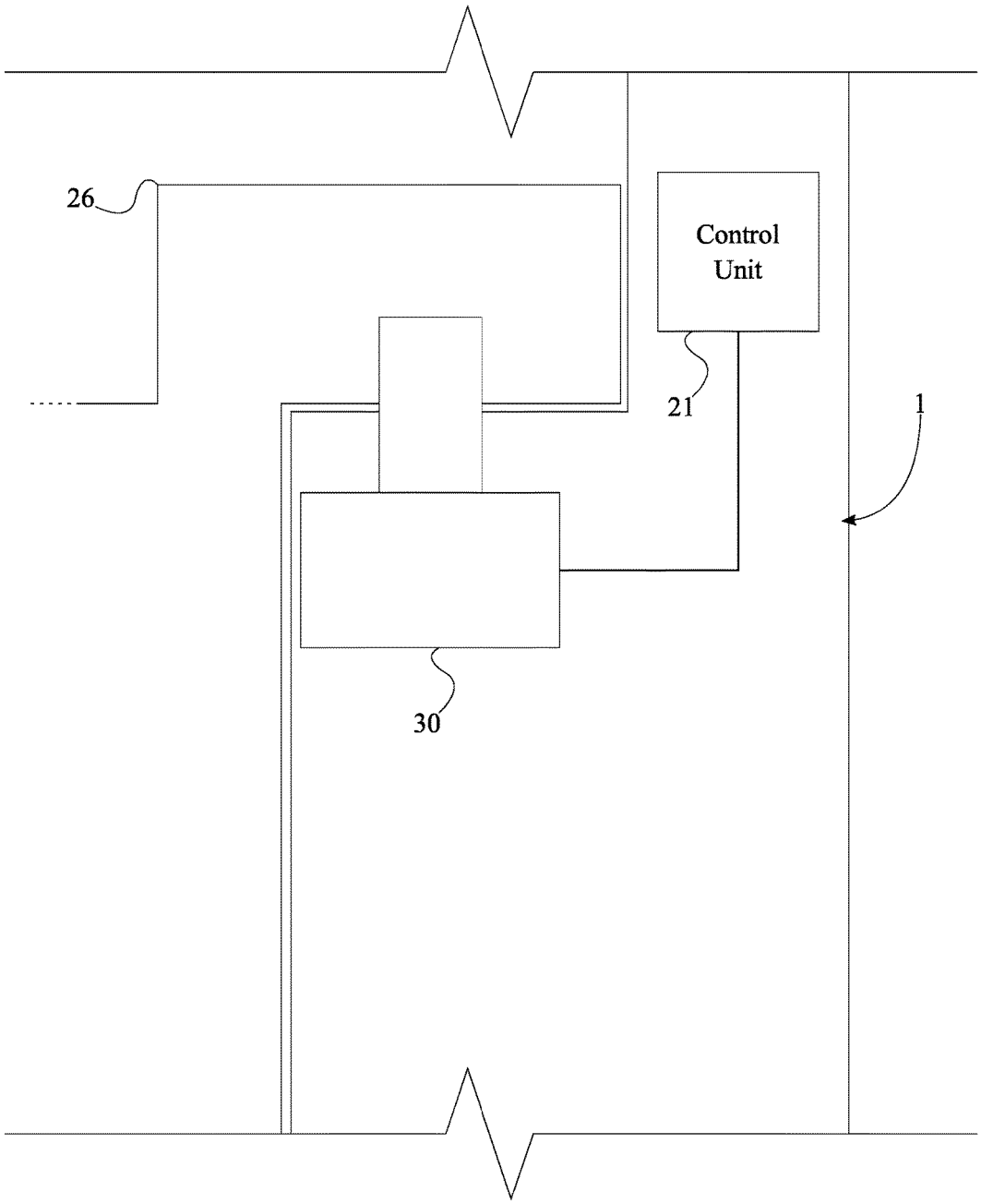
FIG. 12 is a schematic view of the connection between the first output door and the first actuator of the present invention.
Figure 13:
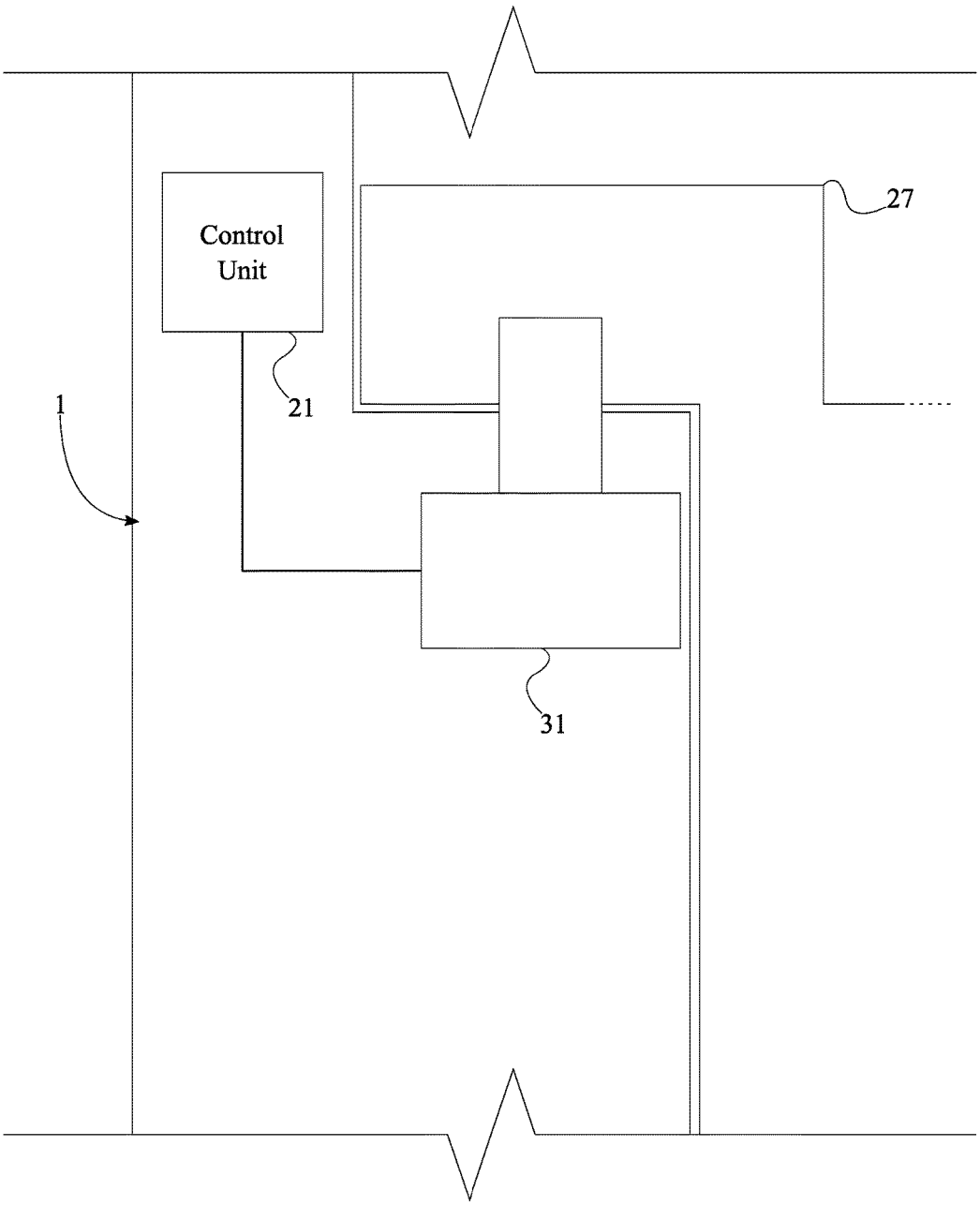
FIG. 13 is a schematic view of the connection between the second output door and the second actuator of the present invention.

Similar to the input door 23, another embodiment of the present invention comprises a first actuator 30 and a second actuator 31, shown in FIG. 12 and FIG. 13. The first actuator 30 and the second actuator 31 automatically engage the first output door 26 and the second output door 27, respectively. The first actuator 30 is operatively coupled in between the first output door 26 and the elongated housing 2, wherein the first actuator 30 is used to open and close the first output door 26 from the second opening 7. The user is able to control the first output door 26 through the control panel 20 as the control unit 21 is electronically connected to the first actuator 30. Similarly, the second actuator 31 is operatively coupled in between the second output door 27 and the elongated housing 2, wherein the second actuator 31 is used to open and close the second output door 27 from the second opening 7. The user is able to control the second output door 27 through the control panel 20 as the control unit 21 is electronically connected to the second actuator 31.

Figure 5:
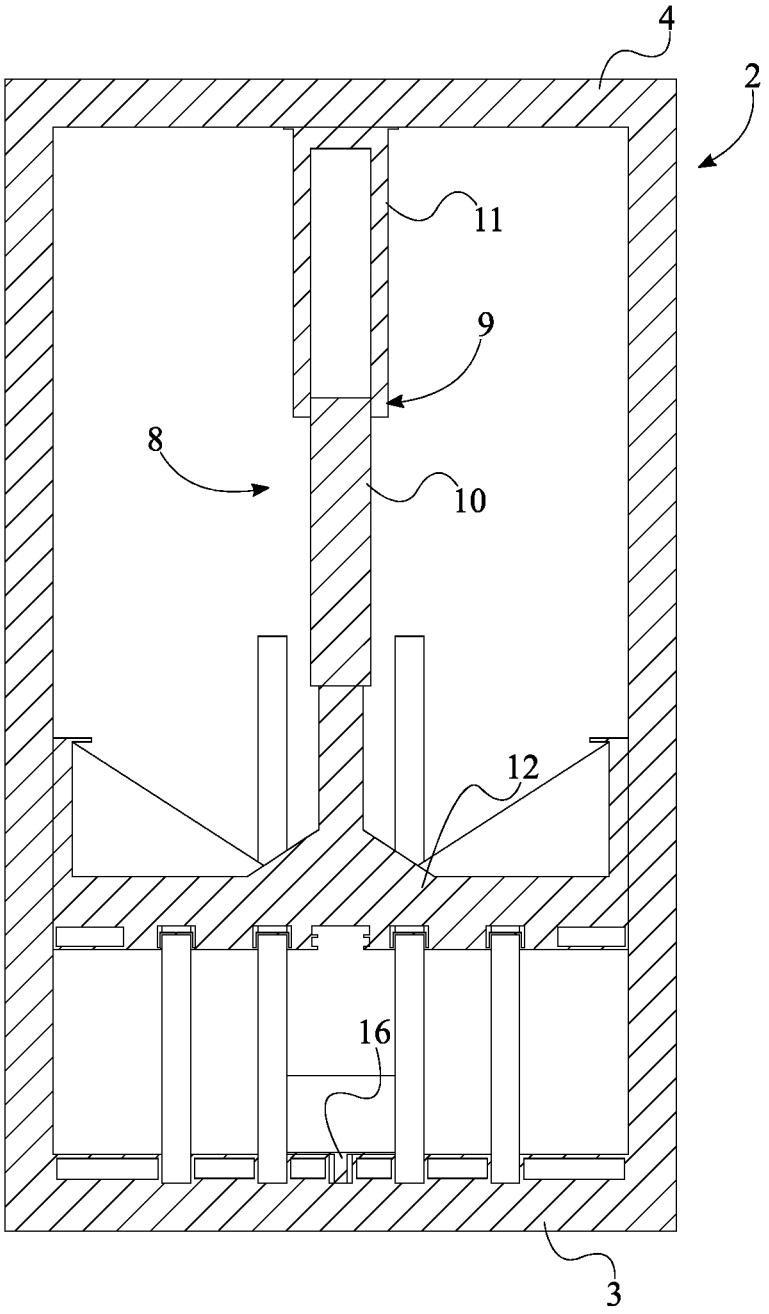
FIG. 5 is a cross-section view of FIG. 4 along line 5-5 with the bailing ram of the preferred embodiment of the present invention in an extended configuration.
Figure 6:
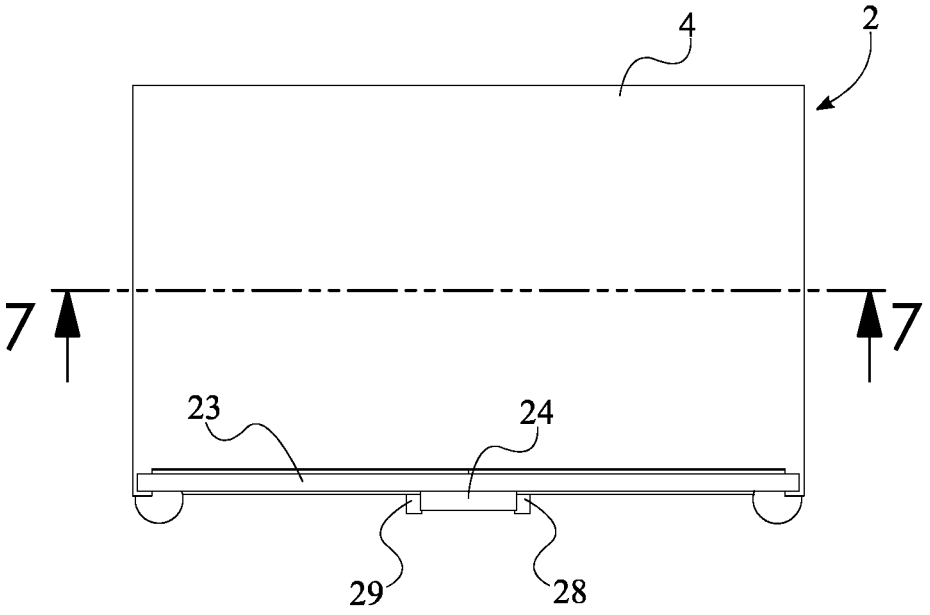
FIG. 6 is a top side view of the preferred embodiment of the present invention.
Figure 7:
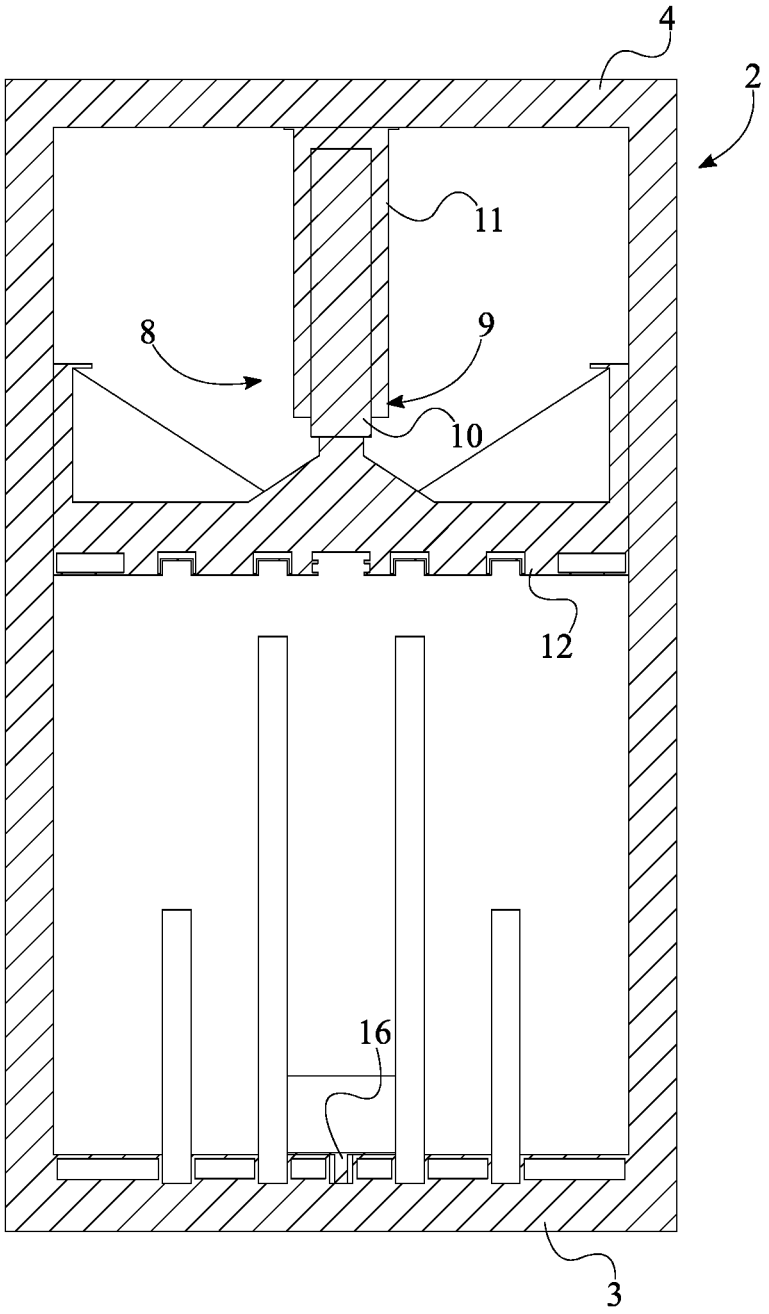
FIG. 7 is a cross-section view of FIG. 6 along line 7-7 with the bailing ram of the preferred embodiment of the present invention in a retracted configuration.

In order for the bailing ram 8 to compress the collection of recyclable items within the elongated housing 2, the bailing ram 8 comprises at least one hydraulic cylinder 9 and a ramming plate 12, seen in FIG. 5 and FIG. 7. The at least one hydraulic cylinder 9 extends and retracts the ramming plate 12. The at least one hydraulic cylinder 9 is able to extend and retract as the at least one hydraulic cylinder 9 comprises a piston 10 and a cylindrical housing 11. The piston 10 delivers the necessary force to the ramming plate 12 and the cylindrical housing 11 lengthens and shortens the distance traversed by the ramming plate 12 within the elongated housing 2. The amount of cylindrical housings 11 depends on the overall height of the elongated housing 2. The ramming plate 12 pushes against the collection of recyclable items and applies the force from the piston 10 across the collection of recyclable within the elongated housing 2.

The overall configuration of the aforementioned components of the bailing ram 8 allows the bailing ram 8 to effectively compress the collection of recyclable items. The piston 10 is slidably mounted within the cylindrical housing 11, also seen in FIG. 5 and FIG. 7. The cylindrical housing 11 is mounted onto a roof 4 of the elongated housing 2, wherein the base 3 and the roof 4 are positioned opposite each other along the elongated housing 2. This arrangement maximizes the number of recyclable items that may be contained within the elongated housing 2. The ramming plate 12 is terminally connected to the piston 10, offset the cylindrical housing 11 and is positioned normal to the at least one hydraulic cylinder 9, thereby allowing the at least one hydraulic cylinder 4 to extend and retract the ramming plate 12 and ramming plate 12 to compress the collection of recyclable items within the elongated housing 2.

Figure 14:
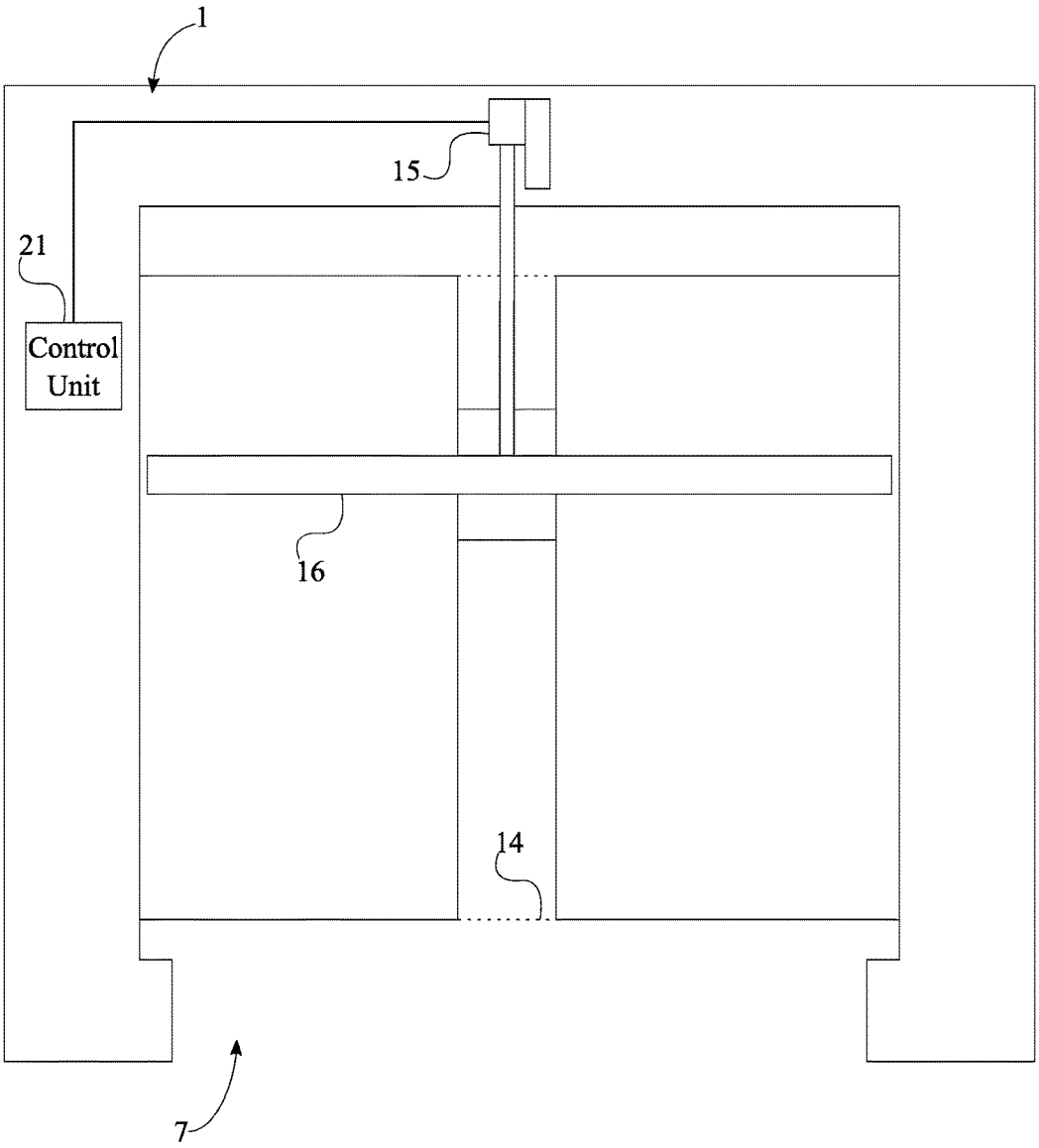
FIG. 14 is a schematic view of the connection between the supporting plate and the ejection actuator of the present invention, with the supporting plate retracted.
Figure 15:
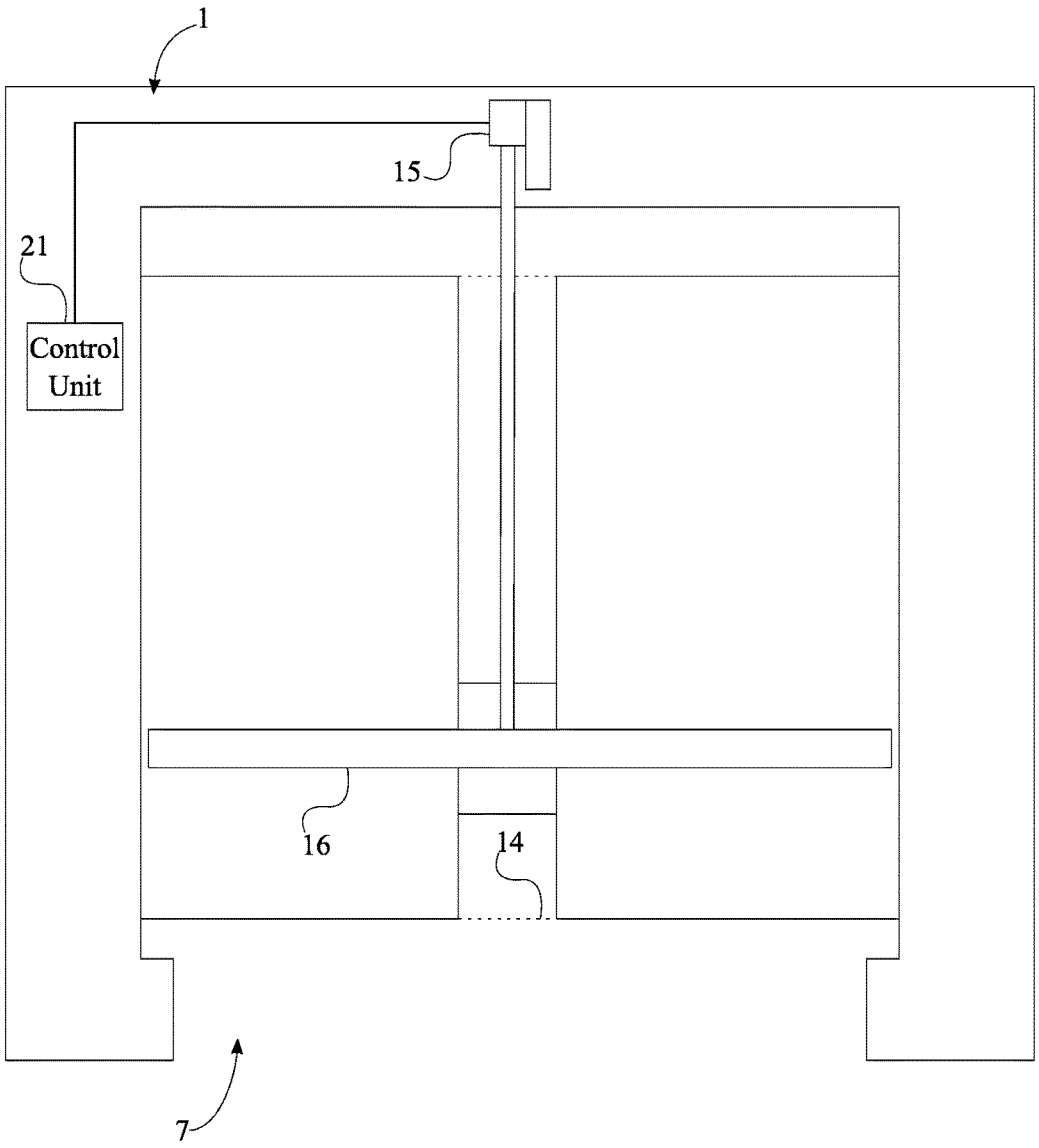
FIG. 15 is a schematic view of the connection between the supporting plate and the ejection actuator of the present invention, with the supporting plate extended.

In order for the ejector mechanism 13 to push the bale of recyclable items from within the elongated housing 2, the ejector mechanism 13 comprises at least one track 14, an ejection actuator 15, and a supporting plate 16, seen in FIG. 3, FIG. 14, and FIG. 15. The at least one track 14 directs and guides the supporting plate 16. In the preferred embodiment of the present invention, the at least one track 14 comprises a left track and a right track, structurally supporting the weight of the bale of recyclable items. The ejection actuator 15 provides the necessary force to the supporting plate 16 to push the bale of recyclable items. The supporting plate 16 supports the entire bale of recyclable items and distributes the force from the ejection actuator 15 across the bale of recyclable items. In order to push the bale of recyclable items, the at least one track 14 is positioned within the elongated housing 2 and is mounted across the base 3 of the elongated housing 2. More specifically, the at least one track 14 is oriented towards the second opening 7. The supporting plate 16 is slidably connected along the at least one track 14 to support the weight of the bale of recyclable items. In order for the bale of recyclable items to be pushed out of the elongated housing 2 without any manual labor from the user, the ejection actuator 15 is operatively coupled in between the supporting plate 16 and the elongated housing 2, wherein the ejection actuator 15 is used to selectively guide the supporting plate 16 towards the second opening 7. In order for the user to automatically output the bale of recyclable items from within the elongated housing 2, the control unit 21 is electronically connected to the tilting actuator 18.

In the preferred embodiment of the present invention, the ejector mechanism 13 further comprises a carriage 17 and a tilting actuator 18, illustrated in FIG. 16. The carriage 17 allows the supporting plate 16 to tilt, and the tilting actuator 18 directs and maneuvers the supporting plate 16 in order to lessen the amount force of the bale of recyclable items against the both the supporting plate 16 and the ejection actuator 15. The carriage 17 is slidably connected along the at least one track 14, preserving the structural support of the ejector mechanism 13. In order for the supporting plate 16 to tilt, the supporting plate 16 is hingedly mounted into the carriage 17 about a rotation axis 19. More specifically, the rotation axis 19 is positioned perpendicular to the at least one track 14. The tilting actuator 18 is operatively coupled in between the supporting plate 16 and the carriage 17, wherein the tilting actuator 18 is used to selectively tilt the supporting plate 16 towards the second opening 7. This arrangement effectively and automatically pushes the bale of recyclable items while securely tilting the supporting plate 16. The user may automatically control the tilting actuator 18, similar to that of the ejection actuator 15, as the control unit 21 is electronically connected to the tilting actuator 18.

Figure 10:
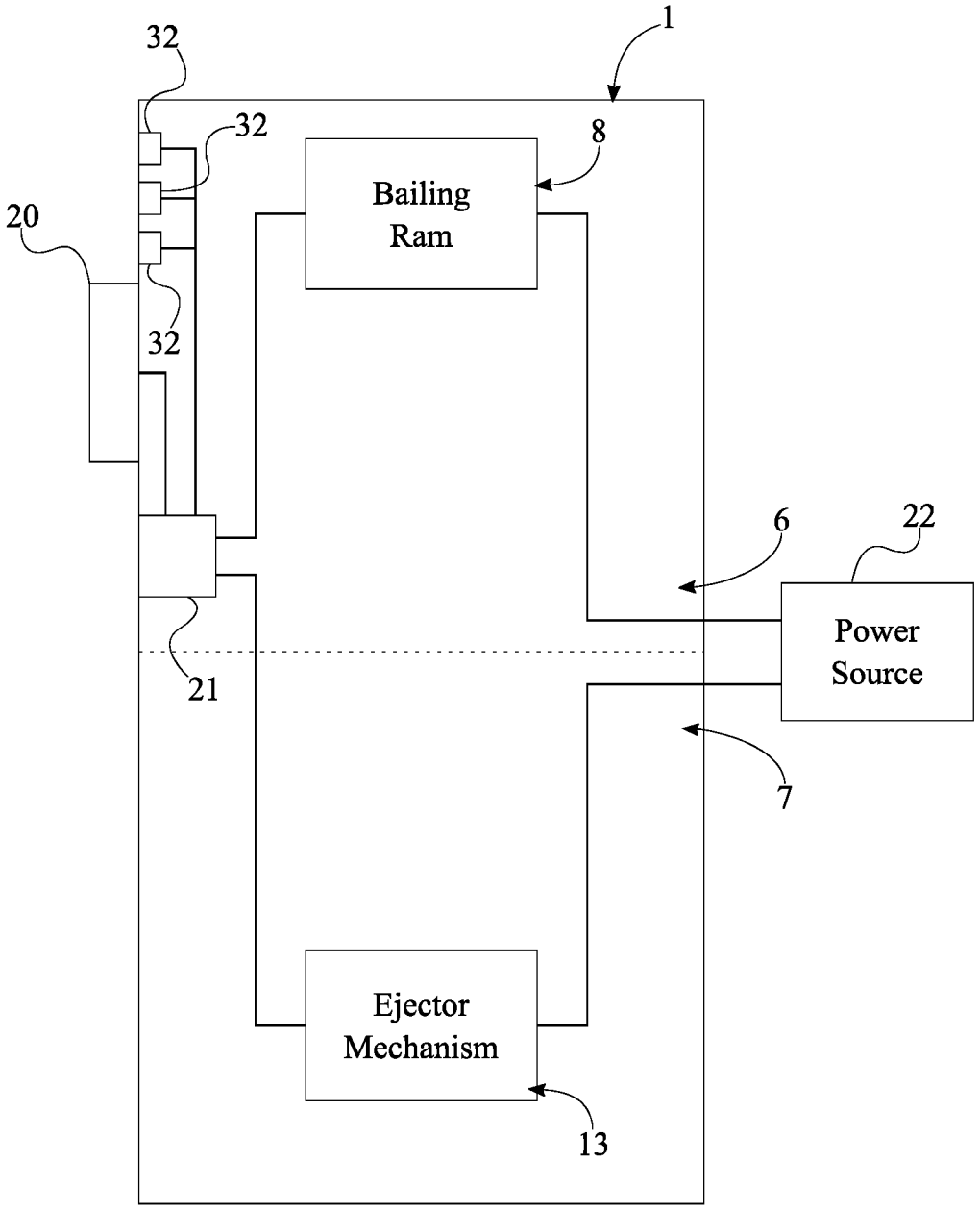
FIG. 10 is a schematic view of the electronic connections of the present invention.

The preferred embodiment of the present invention lessens any injuries or fatalities as the preferred embodiment of the present invention comprises a plurality of environmental sensors 32, shown in FIG. 10. The plurality of environmental sensors 32 detects the presence of a user or a part of a user within the elongated housing 2 and alerts the user of the detection. The plurality of environmental sensors 32 may include, but are not limited to, heat sensors, motion sensors, and photoelectric sensors. The plurality of environmental sensors 32 is mounted within the elongated housing 2 as the bailing ram 8 and the ejector mechanism 13 are positioned within the elongated housing 2. The plurality of environmental sensors 32 is preferably positioned adjacent the first opening 6 in order to prevent the user accidentally passing through the first opening 6 and coming into contact with the bailing ram 8 and ejector mechanism 13 as the first opening 6 is the point of entry of the present invention for recyclable items. The control unit 21 is electronically connected to the plurality of environmental sensors 32 in order for the bailing ram 8 and the ejector mechanism 13 to stop upon the detection of a disturbance along the path of the bailing ram 8 and the ejector mechanism 13.

Figure 8:
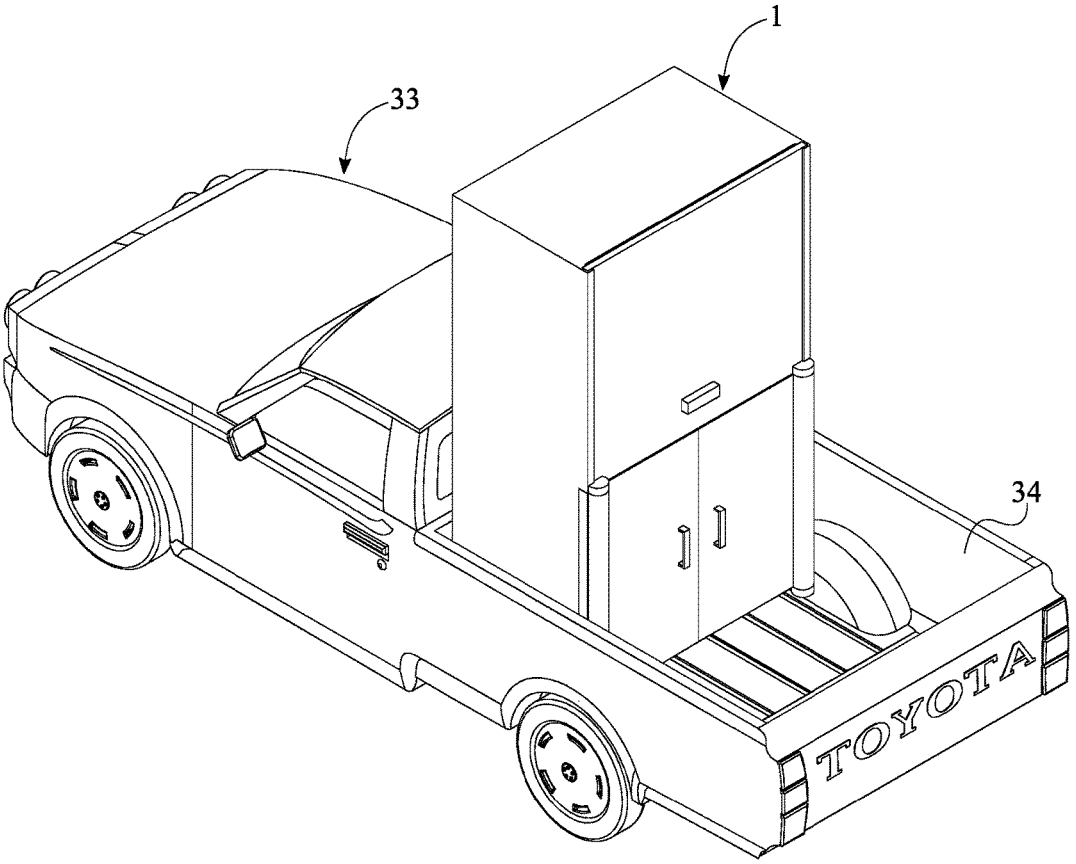
FIG. 8 is a perspective view of an alternate embodiment of the present invention with the enclosure mounted within the bed of a vehicle in a vertical configuration.
Figure 9:
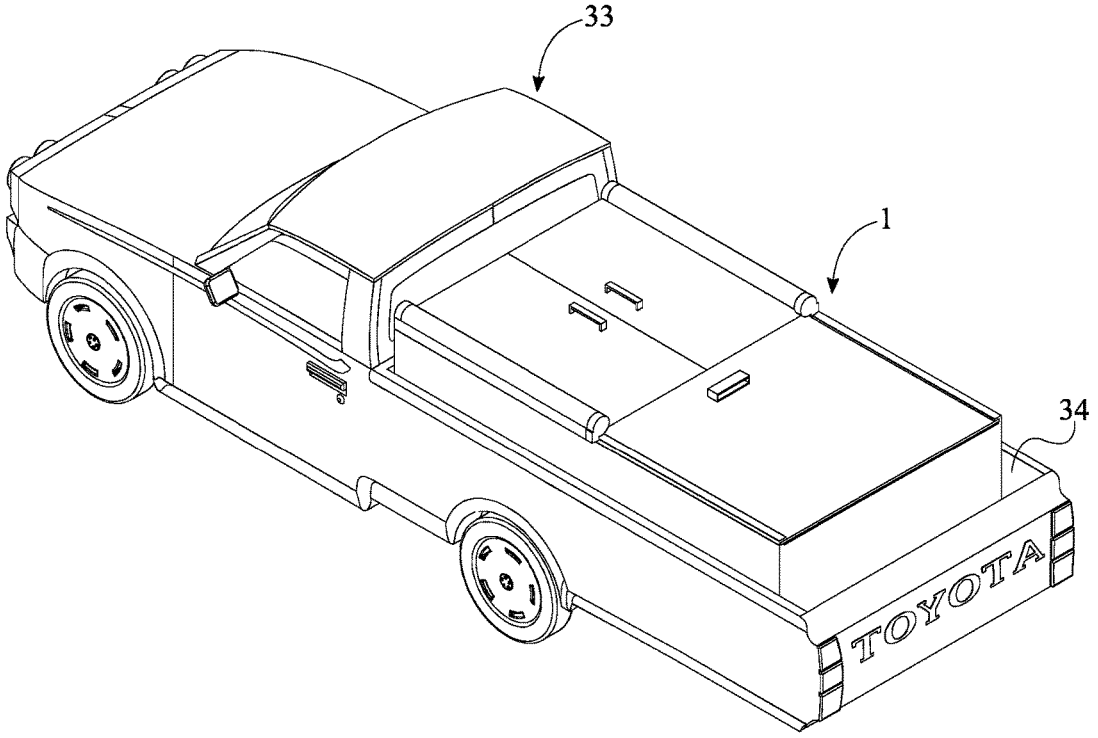
FIG. 9 is a perspective view of the alternate embodiment of the present invention with the enclosure mounted within the bed of a vehicle in a horizontal configuration.

An alternate embodiment of the present invention comprises a vehicle 33, seen in FIG. 8 and FIG. 9. The vehicle 33 directly transports the enclosure 1, the bailing ram 8, and the ejector mechanism 13. The enclosure 1 is mounted within a bed 34 of the vehicle 33, the vehicle 33 preferably being a truck. This arrangement facilitates the insertion of recyclable items directly into the first opening 6 and the retrieval of the bale of recyclable items. The bailing ram 8 and the ejector mechanism 13 are directly powered from the vehicle 33 as the power source 22 is a battery of the vehicle 33 and readily moves with the transportation of the enclosure 1, the bailing ram 8, and the ejector mechanism 13.

As the enclosure 1 is mounted within the bed 34 of the vehicle 33, the enclosure 1 may be in a horizontal configuration or a vertical configuration, depending on the path of transportation and the structure of the vehicle 33. As seen in FIG. 9, while in a horizontal configuration, a backing 5 of the elongated housing 2 is positioned opposite to the first opening 6 and the second opening 7, and the backing 5 is positioned against the bed 34 of the vehicle 33. This configuration rests the enclosure 1 within the bed 34 and without blocking the first opening 6 and the second opening 7. More specifically, the first opening 6 and the second opening 7 are oriented away from the bed 34 of the vehicle 33. As seen in FIG. 8, while in a vertical configuration, the base 3 of the elongated housing 2 is positioned against the bed 34 of the vehicle 33. Moreover, the first opening 6 and the second opening 7 is oriented perpendicular to the bed 34 of the vehicle 33.

Although the invention has been explained in relation to its preferred embodiment, it is to be understood that many other possible modifications and variations can be made without departing from the spirit and scope of the invention as hereinafter claimed.

What is claimed is:

1. A portable cardboard baler comprising:

an enclosure;

a bailing ram;

an ejector mechanism;

a control panel;

a control unit;

a power source;

the enclosure comprising an elongated housing, a first opening, and a second opening;

the first opening and the second opening laterally traversing into the elongated housing;

the first opening and the second opening being positioned offset from each other along the elongated housing;

the bailing ram being operatively mounted within the elongated housing, wherein the bailing ram is used to compress loose items in between the bailing ram and a base of the elongated housing;

the ejector mechanism being operatively mounted within the elongated housing, offset from the second opening, wherein the ejector mechanism is used to push out compressed items from the elongated housing through the second opening;

the control unit being electronically connected to the control panel, the bailing ram, and the ejector mechanism;

the power source being electrically connected to the bailing ram and the ejector mechanism;

the ejector mechanism comprising at least one track, an ejection actuator, and a supporting plate;

the at least one track being positioned within the elongated housing;

the at least one track being mounted across the base of the elongated housing;

the at least one track being oriented towards the second opening;

the supporting plate being slidably connected along the at least one track;

the ejection actuator being operatively coupled in between the supporting plate and the elongated housing, wherein the ejection actuator is used to selectively guide the supporting plate towards the second opening;

the control unit being electronically connected to the ejection actuator;

the ejector mechanism comprising a carriage and a tilting actuator;

the carriage being slidably connected along the at least one track;

the supporting plate being hingedly mounted into the carriage about a rotation axis;

the rotation axis being positioned perpendicular to the at least one track;

the tilting actuator being operatively coupled in between the supporting plate and the carriage, wherein the tilting actuator is used to selectively tilt the supporting plate towards the second opening; and the control unit being electronically connected to the tilting actuator.

2. The portable cardboard baler as claimed in claim 1 comprising:

an input door;

the input door being slidably mounted along the elongated housing; and the input door being positioned adjacent the first opening.

3. The portable cardboard baler as claimed in claim 2 comprising:

a handle;

the handle being mounted onto the input door; and the handle being positioned external to the elongated housing.

4. The portable cardboard baler as claimed in claim 2 comprising:

a lifting actuator;

the lifting actuator being operatively coupled in between the input door and the elongated housing, wherein the lifting actuator is used to open and close the input door from the first opening; and the control unit being electronically connected to the lifting actuator.

5. The portable cardboard baler as claimed in claim 1 comprising:

a first output door;

a second output door;

the first output door being hingedly connected to the elongated housing;

the second output door being hingedly connected to the elongated housing; and the hinged connection between the first output door and the elongated housing and the hinged connection between the second output door and the elongated housing being positioned opposite to each other about the second opening.

6. The portable cardboard baler as claimed in claim 5 comprising:

a first handle;

a second handle;

the first handle being mounted onto the first output door;

the second handle being mounted onto the second output door;

the first handle and the second handle being positioned external to the elongated housing;

the first handle and the hinged connection between the first output door and the elongated housing being positioned opposite to each other across the first output door; and the second handle and the hinged connection between the second output door and the elongated housing being positioned opposite to each other across the second output door.

7. The portable cardboard baler as claimed in claim 5 comprising:

a first actuator;

the first actuator being operatively coupled in between the first output door and the elongated housing, wherein the first actuator is used to open and close the first output door from the second opening; and the control unit being electronically connected to the first actuator.

8. The portable cardboard baler as claimed in claim 5 comprising:

a second actuator;

the second actuator being operatively coupled in between the second output door and the elongated housing, wherein the second actuator is used to open and close the second output door from the second opening; and the control unit being electronically connected to the second actuator.

9. The portable cardboard baler as claimed in claim 1 comprising:

the bailing ram comprising at least one hydraulic cylinder and a ramming plate;

the at least one hydraulic cylinder comprising a piston and a cylindrical housing;

the piston being slidably mounted within the cylindrical housing;

the cylindrical housing being mounted onto a roof of the elongated housing, wherein the base and the roof are positioned opposite each other along the elongated housing;

the ramming plate being terminally connected to the piston, offset from the cylindrical housing; and the ramming plate being positioned normal to the at least one hydraulic cylinder.

10. The portable cardboard baler as claimed in claim 1 comprising:

a plurality of environmental sensors;

the plurality of environmental sensors being mounted within the elongated housing;

the plurality of environmental sensors being positioned adjacent the first opening; and the control unit being electronically connected to the plurality of environmental sensors.

11. The portable cardboard baler as claimed in claim 1 comprising:

a vehicle;

the enclosure being mounted within a bed of the vehicle; and the power source being a battery of the vehicle.

12. The portable cardboard baler as claimed in claim 11 comprising:

a backing of the elongated housing being positioned opposite to the first opening and the second opening;

the backing being positioned against the bed of the vehicle; and the first opening and the second opening being oriented away from the bed of the vehicle.

13. The portable cardboard baler as claimed in claim 11 comprising:

the base of the elongated housing being positioned against the bed of the vehicle; and the first opening and the second opening being oriented perpendicular to the bed of the vehicle.

14. A portable cardboard baler comprising:

an enclosure;

a bailing ram;

an ejector mechanism;

a control panel;

a control unit;

a power source;

a plurality of environmental sensors;

the enclosure comprising an elongated housing, a first opening, and a second opening;

the first opening and the second opening laterally traversing into the elongated housing;

the first opening and the second opening being positioned offset from each other along the elongated housing;

the bailing ram being operatively mounted within the elongated housing, wherein the bailing ram is used to compress loose items in between the bailing ram and a base of the elongated housing;

the ejector mechanism being operatively mounted within the elongated housing, offset from the second opening, wherein the ejector mechanism is used to push out compressed items from the elongated housing through the second opening;

the control unit being electronically connected to the control panel, the bailing ram, and the ejector mechanism;

the power source being electrically connected to the bailing ram and the ejector mechanism;

the plurality of environmental sensors being mounted within the elongated housing;

the plurality of environmental sensors being positioned adjacent the first opening;

the control unit being electronically connected to the plurality of environmental sensors;

the ejector mechanism comprising at least one track, an ejection actuator, and a supporting plate;

the ejector mechanism comprising a carriage and a tilting actuator;

the at least one track being positioned within the elongated housing;

the at least one track being mounted across the base of the elongated housing;

the at least one track being oriented towards the second opening;

the supporting plate being slidably connected along the at least one track;

the ejection actuator being operatively coupled in between the supporting plate and the elongated housing, wherein the ejection actuator is used to selectively guide the supporting plate towards the second opening;

the control unit being electronically connected to the ejection actuator;

the carriage being slidably connected along the at least one track;

the supporting plate being hingedly mounted into the carriage about a rotation axis;

the rotation axis being positioned perpendicular to the at least one track;

the tilting actuator being operatively coupled in between the supporting plate and the carriage, wherein the tilting actuator is used to selectively tilt the supporting plate towards the second opening; and the control unit being electronically connected to the tilting actuator.

15. The portable cardboard baler as claimed in claim 14 comprising:

an input door;

a handle;

the input door being slidably mounted along the elongated housing;

the input door being positioned adjacent the first opening;

the handle being mounted onto the input door; and the handle being positioned external to the elongated housing.

16. The portable cardboard baler as claimed in claim 14 comprising:

a first output door;

a second output door;

a first handle;

a second handle;

the first output door being hingedly connected to the elongated housing;

the second output door being hingedly connected to the elongated housing;

the hinged connection between the first output door and the elongated housing and the hinged connection between the second output door and the elongated housing being positioned opposite to each other about the second opening;

the first handle being mounted onto the first output door;

the second handle being mounted onto the second output door;

the first handle and the second handle being positioned external to the elongated housing;

the first handle and the hinged connection between the first output door and the elongated housing being positioned opposite to each other across the first output door; and the second handle and the hinged connection between the second output door and the elongated housing being positioned opposite to each other across the second output door.

17. The portable cardboard baler as claimed in claim 14 comprising:

the bailing ram comprising at least one hydraulic cylinder and a ramming plate;

the at least one hydraulic cylinder comprising a piston and a cylindrical housing;

the piston being slidably mounted within the cylindrical housing;

the cylindrical housing being mounted onto a roof of the elongated housing, wherein the base and the roof are positioned opposite each other along the elongated housing;

the ramming plate being terminally connected to the piston, offset from the cylindrical housing; and the ramming plate being positioned normal to the at least one hydraulic cylinder.

18. The portable cardboard baler as claimed in claim 1 comprising:

a vehicle;

the enclosure being mounted within a bed of the vehicle; and the power source being a battery of the vehicle.

19. The portable cardboard baler as claimed in claim 18 comprising:

a backing of the elongated housing being positioned opposite to the first opening and the second opening;

the backing being positioned against the bed of the vehicle; and the first opening and the second opening being oriented away from the bed of the vehicle.

20. The portable cardboard baler as claimed in claim 18 comprising:

the base of the elongated housing being positioned against the bed of the vehicle; and the first opening and the second opening being oriented perpendicular to the bed of the vehicle.

21. The portable cardboard baler as claimed in claim 14 comprising:

an input door;

a lifting actuator;

the input door being slidably mounted along the elongated housing;

the input door being positioned adjacent the first opening;

the lifting actuator being operatively coupled in between the input door and the elongated housing, wherein the lifting actuator is used to open and close the input door from the first opening; and the control unit being electronically connected to the lifting actuator.

22. The portable cardboard baler as claimed in claim 14 comprising:

a first output door;

a second output door;

a first actuator;

a second actuator;

the first output door being hingedly connected to the elongated housing;

the second output door being hingedly connected to the elongated housing;

the hinged connection between the first output door and the elongated housing and the hinged connection between the second output door and the elongated housing being positioned opposite to each other about the second opening;

the first actuator being operatively coupled in between the first output door and the elongated housing, wherein the first actuator is used to open and close the first output door from the second opening;

the control unit being electronically connected to the first actuator;

the second actuator being operatively coupled in between the second output door and the elongated housing, wherein the second actuator is used to open and close the second output door from the second opening; and the control unit being electronically connected to the second actuator.

* * * * *